US005316889A

United States Patent [19]

Sakai

[11] Patent Number: 5,316,889

[45] Date of Patent: May 31, 1994

[54] SILVER HALIDE PHOTOGRAPHIC MATERIAL AND PHOTOGRAPHIC IMAGE FORMING METHOD USING THE SAME

[75] Inventor: Minoru Sakai, Kanagawa, Japan

[73] Assignee: Fuji Photo Film Co., Ltd., Kanagawa, Japan

[21] Appl. No.: 41,325

[22] Filed: Mar. 31, 1993

[30] Foreign Application Priority Data

Mar. 31, 1992 [JP] Japan ..... 4-103815

[51] Int. Cl.[5] ..... G03C 1/06

[52] U.S. Cl. ..... 430/264; 430/598; 430/410

[58] Field of Search ..... 430/264, 598, 410

[56] References Cited

U.S. PATENT DOCUMENTS

| | | | |
|---|---|---|---|
| 4,447,522 | 5/1984 | Hirano et al. | 430/264 |
| 4,851,321 | 7/1989 | Takagi et al. | 430/264 |
| 4,971,890 | 11/1990 | Okada et al. | 430/264 |
| 4,988,604 | 1/1991 | Machonkin et al. | 430/264 |
| 4,994,365 | 2/1991 | Looker et al. | 430/598 |
| 5,041,355 | 8/1991 | Machonkin et al. | 430/264 |
| 5,041,355 | 8/1991 | Machonkin et al. | 430/264 |
| 5,126,227 | 6/1992 | Machonkin et al. | 430/264 |
| 5,139,921 | 8/1992 | Takagi et al. | 430/264 |
| 5,153,098 | 10/1992 | Takagi | 430/264 |
| 5,210,002 | 5/1993 | Adin | 430/264 |
| 5,213,944 | 5/1993 | Adin | 430/264 |

*Primary Examiner*—Thomas R. Neville
*Attorney, Agent, or Firm*—Sughrue, Mion, Zinn, Macpeak & Seas

[57] ABSTRACT

A silver halide photographic material comprising a support having thereon at least one light-sensitive silver halide emulsion layer, wherein at least one of the silver halide emulsion layer and a hydrophilic colloid layer(s) adjacent thereto contains at least one hydrazine compound represented by the following general formula (I) and at least one compound selected from the group consisting of compounds represented by the following general formula (II) and (III):

(I)

wherein $R_1$ represents an aliphatic or aromatic group which has a substituent having a moiety of $-O(CH_2CH_2O)_n-$, $-O-(CH_2CH(CH_3)O)_n-$ or $-O-(CH_2CH(OH)CH_2O)_n-$ (wherein n is an integer of not smaller than 3) as part of a substituent or having a moiety of a quaternary ammonium cation as part of a substituent group, $G_1$ represents a bivalent bonding group consisting of at least one of —CO—, —COCO—, —CS—, $-C(=NG_2R_2)-$, —SO—, $-SO_2-$ or $-P(O)(G_2R_2)-$; $G_2$ represents a single bond, —O—, —S— or $-N(R_2)-$; $R_2$ represents an aliphatic group, an aromatic group or a hydrogen atom, and when there are two or more $R_2$ groups, they may be the same or different; and one of $A_1$ and $A_2$ is a hydrogen atom, and the other is a hydrogen atom, an acyl group or an alkyl- or arylsulfonyl group, when $R_1$ contains said quaternary ammonium cation, the compound further has a counter anion or has an anion group at $R_1$ to form an inner salt;

(II)

wherein Y represents a group which is adsorbed to silver halide; X represents a bivalent bonding group comprising an atom or atoms selected from hydrogen, carbon, nitrogen, oxygen and sulfur atoms; A represents a bivalent bonding group; B represents an amino group which may be substituted, an ammonium group or a nitrogen-containing heterocyclic ring; m represents 1, 2 or 3; and n represents 0 or 1;

(III)

wherein $R_1$ and $R_2$ each represents a hydrogen atom or an aliphatic group, or $R_1$ and $R_2$ may be combined together to form a ring; $R_3$ represents a bivalent aliphatic (Abstract continued on next page.)

group; X represents a bivalent heterocyclic ring having at least one of hetero-atoms of a nitrogen, oxygen or sulfur atoms; n represents 0 or 1; and M represents a hydrogen atom, an alkali metal atom, an alkaline earth metal atom, a quaternary ammonium, a quaternary phosphonium or an amidino group; x is 1 when M represents a monovalent atom or group and x is ½ when M represents a divalent atom; said compound may be in the form of an addition salt.

17 Claims, No Drawings

SILVER HALIDE PHOTOGRAPHIC MATERIAL AND PHOTOGRAPHIC IMAGE FORMING METHOD USING THE SAME

FIELD OF THE INVENTION

This invention relates to a silver halide photographic material, and more particularly, to an ultra-high-contrast silver halide photographic material suitable for use in photomechanical processes.

BACKGROUND OF THE INVENTION

It is known to add hydrazine compounds to photographic silver halide emulsions or developing solutions. For example, the addition of hydrazine compounds to photographic silver halide emulsions or developing solutions is disclosed in U.S. Pat. No. 3,730,727 (a developing solution containing a combination of ascorbic acid with hydrazine), U.S. Pat. No. 3,227,552 (the use of hydrazine as an auxiliary developing agent to obtain a direct positive color image), U.S. Pat. No. 3,386,831 (silver halide photographic material containing β-monophenyl hydrazides of aliphatic carboxylic acids as stabilizers), U.S. Pat. No. 2,419,975 and Mees, *The Theory of Photographic Process*, the third edition (1966), page 281.

Among them, U.S. Pat. No. 2,419,975 discloses that a high-contrast negative image can be obtained by adding hydrazine compounds.

It is disclosed in the aforesaid U.S. Pat. No. 2,419,975 that very high-contrast photographic characteristics having a gamma (γ) value higher than 10 can be obtained when a hydrazine compound is added to a silver chlorobromide emulsion and development is carried out with a developing solution having a pH of as high as 12.8. However, a strongly alkaline developing solution having a pH of nearly 13 is likely to be oxidized by air, and hence the developing solution is unstable and can not withstand the storage or the use over a long period of time.

Attempts have been made to obtain a high-contrast image by developing silver halide photographic materials containing hydrazine compounds with a developing solution having a lower pH.

JP-A-1-179939 (the term "JP-A" as used herein means an "unexamined published Japanese patent application") and JP-A-1-179940 (these applications correspond to EP324,426A) disclose a processing method wherein photographic materials containing a nucleating development accelerator having an adsorptive group to silver halide grains and a nucleating agent having an adsorptive group are developed with a developing solution having a pH of not higher than 11.0. However, when the amounts of the compounds having an adsorptive group added to silver halide emulsions exceed a critical amount, there are the problems that light sensitivity is deteriorated, development is restrained, and the compounds interfere with the effect of other useful adsorptive additives. Accordingly, the amount of the compound having an adsorptive group to be added is limited to a certain range, and a sufficiently high contrast can not be achieved.

U.S. Pat. Nos. 4,998,604 and 4,994,365 disclose hydrazine compounds having a repeating unit derived from ethylene oxide and hydrazine compounds having a pyridinium group. However, as is clear from Examples of the above patent specification, high contrast is not sufficient, and there is a difficulty in obtaining high contrast and necessary Dmax under practical processing conditions.

JP-A-60-140340 discloses that a high contrast can be obtained by adding an amine into a silver halide photographic material. However, when a developer having a pH of lower than 11.0 is used for development of this photographic material, a sufficient high contrast cannot be achieved.

JP-A-56-106244 discloses that a high contrast can be achieved by adding an amino compound into a developer having a pH of 10 to 12. However, when the developer is used there occur troubles with respect to smell, stain which occurs by adhering of the amino compound to an apparatus for processings, or environmental pollutions. Even though it has been demanded to incorporate such compounds into a photographic material, compounds which provide sufficient effects by incorporating them into a photographic material have not been found.

JP-A-61-47943 and JP-A-61-47949 disclose photographic materials containing hydrazines and sensitizing dyes selected from thiohydantoins. However, high contrast can be obtained only when photographic materials containing the sensitizing dyes and the hydrazines in combination are developed with a developing solution having a pH of higher than 11. High contrast can not be obtained by using a developing solution having a lower pH as intended by the present invention, namely, by using a developing solution having a pH of not higher than 11.

As mentioned above, sufficient high contrast could not be obtained when conventional photographic materials were developed with a developing solution having a pH of not higher than 11.

SUMMARY OF THE INVENTION

Accordingly, an object of the present invention is to provide a silver halide photographic material which offers photographic characteristics having very high contrast negative gradation with a gamma value of higher than 10 using a stable developing solution.

Another object of the present invention is to provide a silver halide photographic material which provides high contrast using a developing solution having a pH of not higher than 11.

The above-described objects of the present invention have been achieved by a silver halide photographic material comprising a support having thereon at least one light sensitive silver halide emulsion layer, wherein at least one of the light-sensitive silver halide emulsion layer and a hydrophilic colloid layer(s) adjacent thereto contain(s) at least one hydrazine derivative represented by the following general formula (I) and at least one compound selected from the group consisting of compounds represented by the following general formula (II) and (III):

$$R_1-\underset{\underset{A_1}{|}}{N}-\underset{\underset{A_2}{|}}{N}-G_1-R_2 \qquad (I)$$

wherein $R_1$ represents an aliphatic or aromatic group which has a substituent having a moiety of $-O-(CH_2CH_2O)_n-$, $-O-(CH_2CH(CH_3)O)_n-$ or $-O-(CH_2CH(OH)CH_2O)_n-$ (wherein n is an integer of not smaller than 3) as part of a substituent or having a moiety of a quaternary ammonium cation as part of a substituent group, $G_1$ represents a bivalent bonding group consisting of at least one of —CO—, —COCO—, —CS—, —C(=$NG_2R_2$)—, —SO—, —$SO_2$— or —P(O)($G_2R_2$)—; $G_2$ represents a single bond, —O—, —S— or —N($R_2$)—; $R_2$ represents an aliphatic group, an aromatic group or a hydrogen atom, and when there are two or more $R_2$ groups, they may be the same or different; and one of $A_1$ and $A_2$ is a hydrogen atom, and the other is a hydrogen atom, an acyl group or an alkyl- or arylsulfonyl group, when $R_1$ contains said quaternary ammonium cation, the compound further has a counter anion or has an anion group at $R_1$ to form an inner salt;

$$Y\text{-}[(\text{-}X\text{-})_n A\text{-}B]_m \quad \text{(II)}$$

wherein Y represents a group which is adsorbed to silver halide; X represents a bivalent bonding group composed of an atom or atoms selected from hydrogen, carbon, nitrogen, oxygen and sulfur atoms; A represents a bivalent bonding group; B represents an amino group which may be substituted, an ammonium group or a nitrogen-containing heterocyclic group; m represents 1, 2 or 3; and n represents 0 or 1,

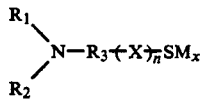

(III)

wherein $R_1$ and $R_2$ each represents a hydrogen atom or an aliphatic group, or $R_1$ and $R_2$ may be combined together to form a ring; $R_3$ represents a bivalent aliphatic group; X represents a bivalent heterocyclic ring having at least one of nitrogen, oxygen and sulfur atoms as hetero-atom; n represents 0 or 1; and M represents a hydrogen atom, an alkali metal atom, an alkaline earth metal atom, a quaternary ammonium, a quaternary phosphonium or an amidino group; x is 1 when M represents a monovalent, atom or group and x is ½ when M represents a divalent atom; said compound may be in the form of an addition salt.

DETAILED DESCRIPTION OF THE INVENTION

The compounds of general formulas (I), (II) and (III) are illustrated in more detail below.

In the present invention an acyl group and an acyl moiety include an aliphatic and aromatic acyl groups and an aliphatic and aromatic acyl moieties, respectively; and the number of carbon atoms of a group include also the number of carbon atoms in the substituent of the group.

The aliphatic group represented by $R_1$ in general formula (I) includes alicyclic group and is preferably a straight-chain, branched or cyclic alkyl group having 1 to 30 carbon atoms, particularly preferably 1 to 20 carbon atoms. The alkyl group is substituted.

The aromatic group represented by $R_1$ in general formula (I) is a monocyclic or bicyclic aryl group or an unsaturated heterocyclic group. The unsaturated heterocyclic group may be fused with the aryl group to form a heteroaryl group.

Examples thereof include a benzene ring, a naphthalene ring, a pyridine ring, a quinoline ring and an isoquinoline ring. Among them, a group having a benzene ring is preferred.

Particularly preferably, $R_1$ is an aryl group.

The aliphatic group or the aromatic group is substituted. Typical examples of the substituents include an alkyl group, an aralkyl group, an alkenyl group, an alkynyl group, an alkoxy group, an aryl group, a substituted amino group, a ureido group, a urethane group (e.g., alkoxycarbonyl amino and aryloxycarbonyl amino), an aryloxy group, a sulfamoyl group, a carbamoyl group, an alkylthio group, an arylthio group, a sulfonyl group, a sulfinyl group, a hydroxy group, a halogen atom (e.g., F, Cl, Br and I), a cyano group, —$SO_3M'_y$, —$COOM'_y$ (wherein M' represents a hydrogen atom, an alkali metal atom such as Li, K and Na, $NH_4$ and an alkaline earth metal atom such as Ca and Mg; and y is 1, when M' represents a monovalent atom or group and y is ½ when M' represents a divalent atom), an aryloxycarbonyl group, an acyl group, an alkoxycarbonyl group, an acyloxy group, a carbonamido group, a sulfonamido group, and a phosphoric acid amido group. The total number of carbon atoms in the substituent preferably is not more than 40.

Preferred examples of the substituent groups include a straight-chain, branched or cyclic alkyl group (having preferably 1 to 20 carbon atoms), an aralkyl group (having preferably 7 to 30 carbon atoms), an alkoxy group (having preferably 1 to 30 carbon atoms), a substituted amino group (e.g., an amino group substituted by at least one alkyl group having preferably 1 to 30 carbon atoms), an acylamino group (having preferably 2 to 40 carbon atoms), a sulfonamido group (having preferably 1 to 40 carbon atoms), a ureido group (having preferably 1 to 40 carbon atoms) and a phosphoric acid amido group (having preferably 1 to 40 carbon atoms).

the substituent for the aliphatic group or the aromatic group represented by $R_1$ further has a moiety of —O—$(CH_2CH_2O)_n$—, O$(CH_2CH(CH_3)O)_n$—, or —O—$(CH_2CH(OH)CH_2O)_n$— (wherein n is an integer of not smaller than 3, preferably 3 to 15) or a quaternary ammonium cation as a moiety of the substituent.

Examples of the counter anion in formula (I) include a halide ion (e.g., $P^{\ominus}$, $Cl^{\ominus}$, $Br^{\ominus}$ and $I^{\ominus}$), a toluenesulfonate ion and a naphthalenesulfonate ion. Examples of an anion include —$SO_3^{\ominus}$ and —$COO^{\ominus}$.

Preferably, $R_1$ is a group represented by the following general formula (Ia), (Ib), (Ic) or (Id):

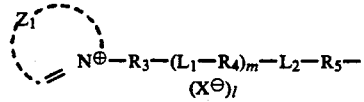

(Ia)

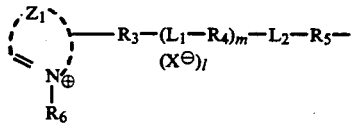

(Ib)

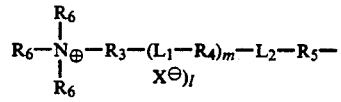

(Ic)

$$R_6\text{—O—}(L_3)_n\text{—}R_3\text{—}(L_1\text{—}R_4)_m\text{—}L_2\text{—}R_5\text{—} \quad \text{(Id)}$$

wherein $L_1$ and $L_2$ may be the same or different and each represents —$CONR_7$—, —$NR_7CONR_8$—, —$SO_2NR_7$— or —$NR_7SO_2NR_8$—; $R_7$ and $R_8$ each represents a hydrogen atom, an alkyl group having 1 to 6 carbon atoms or an aryl group having 6 to 10 carbon atoms, with a hydrogen atom being preferred; and l and m each represents 0 or 1.

$R_3$ and $R_4$ each represents a bivalent aliphatic group, aromatic group, a combination thereof, or a bivalent group composed of a combination of an aliphatic group and/or an aromatic group with at least one of —O—, —CO—, —S—, —SO—, —$SO_2$ and —$NR_9$— [$R_9$ has the same meaning as $R_7$ in general formulas (Ia), (Ib) and (Ic)]. Preferably, the aliphatic group is an alkylene group and the aromatic group is an arylene group.

$R_5$ represents an aliphatic group, an aromatic group or a combination thereof, preferably an alkylene group or an arylene group or a combination of an alkylene group with an arylene group.

More preferably, $R_3$ is an alkylene group having 1 to 10 carbon atoms or a bivalent group composed of a combination of the alkylene group with at least one of —S—, —SO— and —$SO_2$—, and $R_4$ and $R_5$ are each an arylene group having 6 to 20 carbon atoms. Particularly preferably, $R_5$ is a phenylene group.

$R_3$, $R_4$ and $R_5$ may be substituted. Preferred examples of substituents include those already described above in the definition of the substituents for $R_1$.

In general formulas (Ia) and (Ib), $Z_1$ represents an atomic group required for forming a nitrogen-containing aromatic ring which may be fused with a benzene ring or with a heterocyclic ring preferably 5- or 6-membered ring containing at least one of N, O, and S atoms as hetero-atom. The nitrogen containing aromatic ring is preferably a 5- to 6-membered ring which may further contain at least one of N, O and S atoms. Preferred examples of the nitrogen-containing aromatic ring formed by $Z_1$ together with the nitrogen atom include a pyridine ring, a pyrimidine ring, a pyridazine ring, a pyrazine ring, an imidazole ring, a pyrazole ring, a pyrrole ring, an oxazole ring, a thiazole ring and benzo-fused rings thereof, a pteridine ring and a naphthyridine ring.

In general formulas (Ia), (Ib) and (Ic), when $l=1$ $X^{\ominus}$ represents a counter anion or a counter anion moiety (such as a halide anion (e.g., $F^{\ominus}$, $Cl^{\ominus}$, $Br^{\ominus}$ and $I^{\ominus}$), a toluenesulfonate anion and a naphthalenesulfonate anion), and when $l=0$ $Z_1$ or $R_6$ has an anion such as —$SO_3^{\ominus}$ or —$COO^{\ominus}$ to form an inner salt.

In general formulas (Ib), (Ic) and (Id), $R_6$ represents an aliphatic or aromatic group. Preferably, $R_6$ is an alkyl group having 1 to 20 carbon atoms or an aryl group having 6 to 20 carbon atoms.

In general formula (Ic), the three $R_6$ groups may be the same or different, or may be combined together to form a ring.

$Z_1$ and $R_6$ may be substituted. Preferred examples of substituent groups include those already described above in the definition of the substituent groups for $R_1$.

In general formula (Id), $L_3$ represents —$CH_2CH_2O$— group, —$CH_2CH(CH_3)O$— group or —$CH_2CH(OH)CH_2O$— group; and n is as defined above in general formula (I).

In general formula (I), $G_1$ is preferably —CO— or —$SO_2$—, with —CO— being most preferred.

$A_1$ and $A_2$ are each preferably a hydrogen atom.

The aliphatic group represented by $R_2$ in general formula (I) is preferably an alkyl group, and more preferably 1 to 4 carbon atoms, and the aromtic group is preferably a monocyclic or bicyclic aryl group (e.g., a group containing a benzene ring).

When $G_1$ is —CO—, $R_2$ is preferably a hydrogen atom, an alkyl group (e.g., methyl group, trifluoromethyl group, 3-hydroxypropyl group, 3-methanesulfonamidopropyl group, phenylsulfonylmethyl group), an aralkyl group (e.g., o-hydroxybenzyl group) or an aryl group (e.g., phenyl group, 3,5-dichlorophenyl group, o-methanesulfonamidophenyl group, 4-methanesulfonylphenyl group, 2-hydroxymethylphenyl group) with a hydrogen atom being particularly preferred.

$R_2$ may be substituted. Examples of substituent groups include those described above in the definition of the substituent groups for $R_1$ and a nitrogen-containing aromatic ring which are described above in the definition of $Z_1$.

$R_2$ may be a group which causes the cleavage of the $G_1$-$R_2$ moiety from the remainder of the molecule (during development) and a cyclization reaction to form a ring structure having the atoms of the $G_1$-$R_2$ moiety. Examples of the group include those described in JP-A-63-29751 and examples of compounds having such a group are Compounds 28, 37 and 40 which are shown hereinafter.

In general formula (I), $R_1$ or $R_2$ may have a ballast group or a polymer moiety conventionally used in immobile photographic additives such as couplers. The ballast group is a group which has not less than 8 carbon atoms and is relatively inert to photographic characteristics. Examples of the ballast group include an alkyl group, an alkoxy group, a phenyl group, an alkylphenyl group, a phenoxy group and an alkylphenoxy group. Examples of the polymer include those described in JP-A-1-100530.

Further, $R_1$ or $R_2$ in general formula (I) may have a group as a moiety thereof by which the adsorption of the compound on the surface of silver halide grains is enhanced. Examples of such adsorptive group as a moiety of $R_1$ or $R_2$ include groups such as a thiourea group, a heterocyclic thioamido group, a mercapto heterocyclic group described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

Among the compounds of general formula (I), the compounds of general formulas (Ib) and (Ic) are particularly preferred. The compounds of general formula (I) according to the present invention can be synthesized, for example, by using the methods described in JP-A-61-213847, JP-A-62-260153, U.S. Pat. No. 4,684,604, JP-A-1-269936, U.S. Pat. Nos. 3,379,529, 3,620,746, 4,377,634 and 4,332,878, JP-A-49-129536, JP-A-56-153336, JP-A-56-153342, U.S. Pat. Nos. 4,988,604 and 4,994,365.

Examples of the compounds which can be used in the present invention include, but are not limited to, the following compounds:

Compound 1
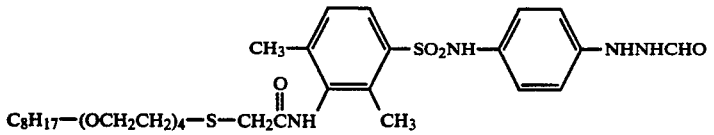
Compound 2
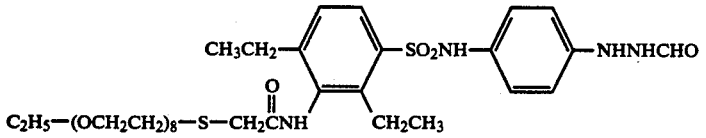
Compound 3
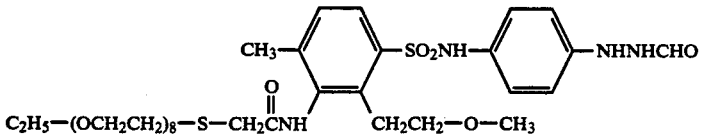
Compound 4
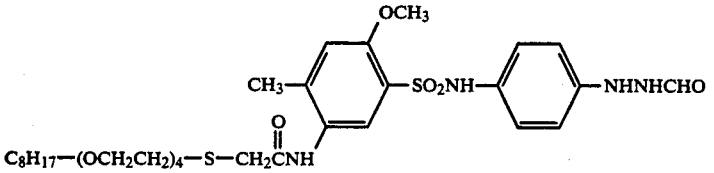
Compound 5
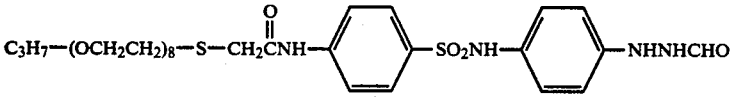
Compound 6
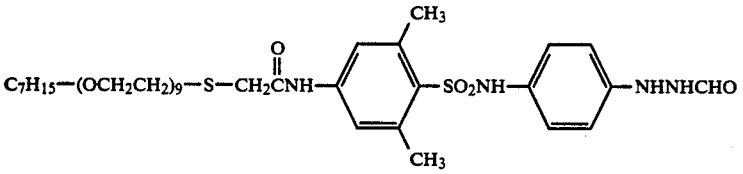
Compound 7
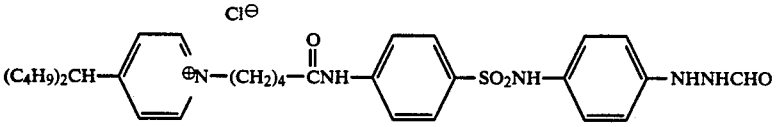
Compound 8
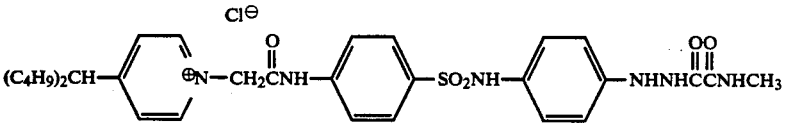
Compound 9
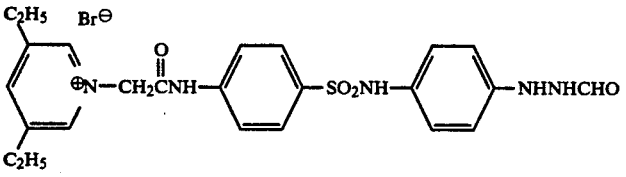
Compound 10
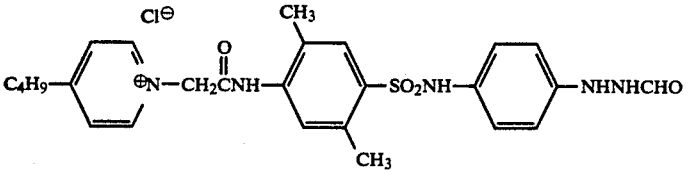

-continued
Compound 11
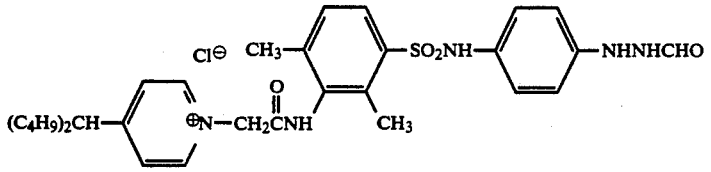
Compound 12
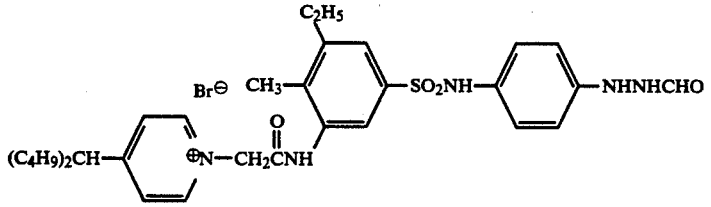
Compound 13
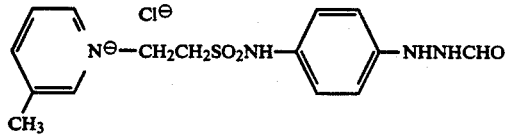
Compound 14
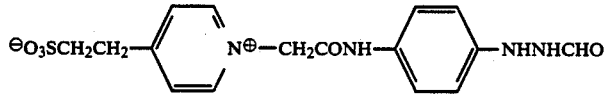
Compound 15
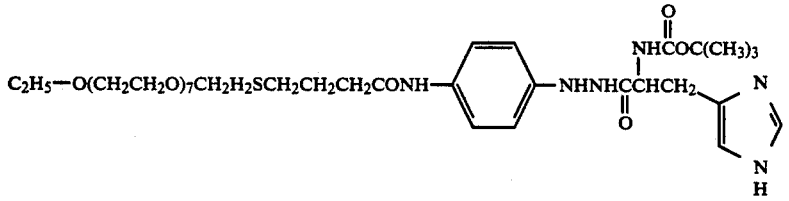
Compound 16
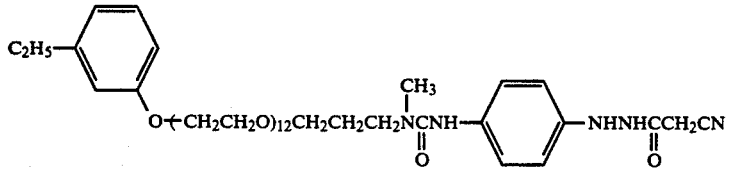
Compound 17
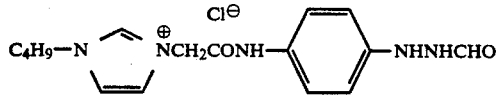
Compound 18
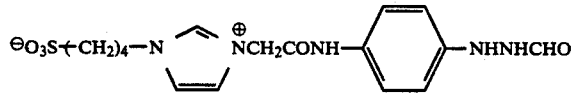
Compound 19
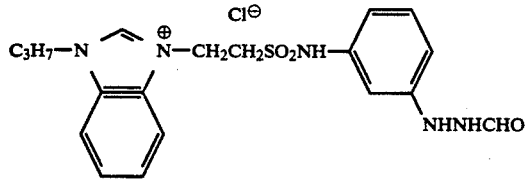
Compound 20
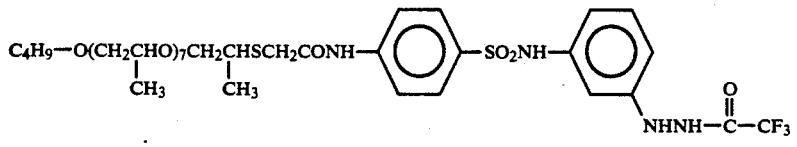

-continued
Compound 21
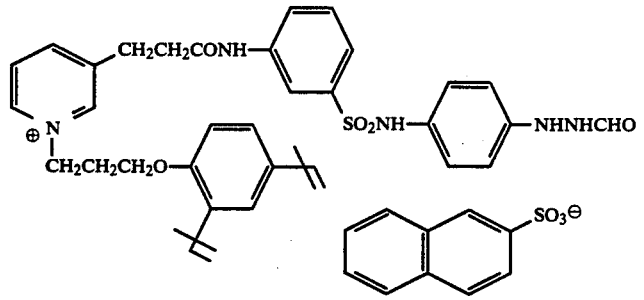
Compound 22
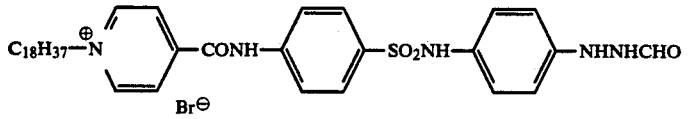
Compound 23
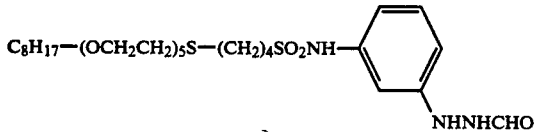
Compound 24
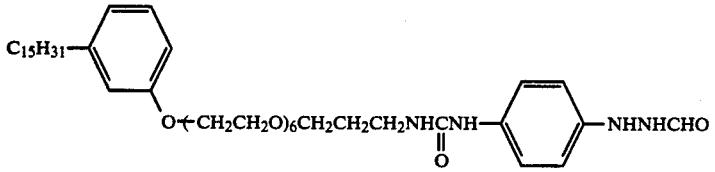
Compound 25
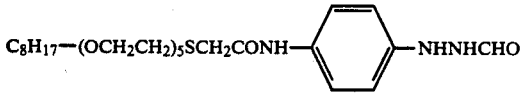
Compound 26
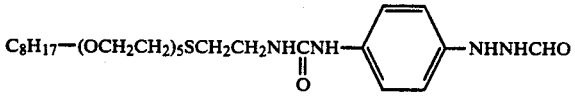
Compound 27
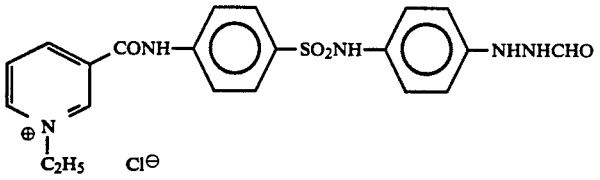
Compound 28
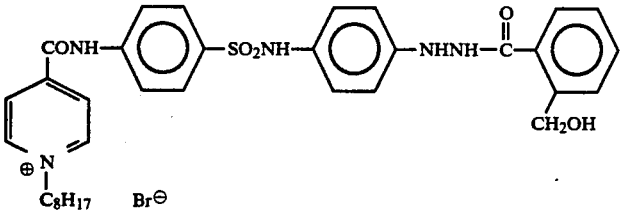
Compound 29
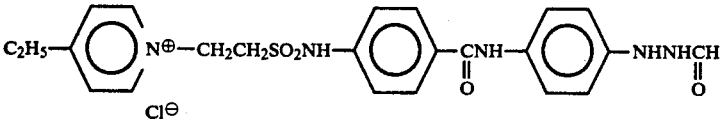

-continued
Compound 30
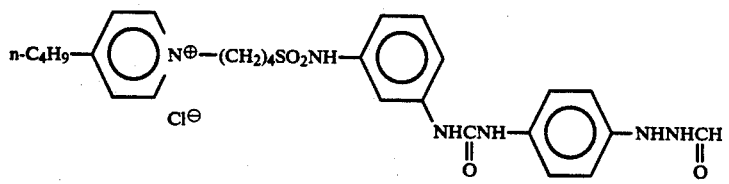
Compound 31
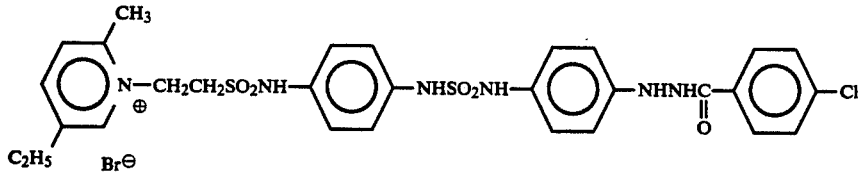
Compound 32
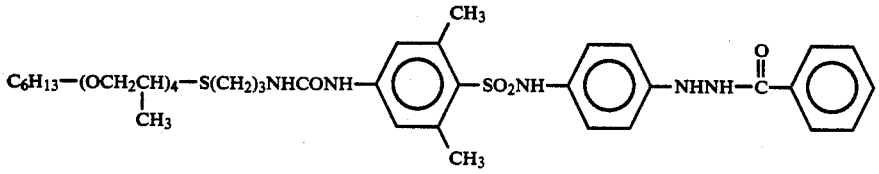
Compound 33
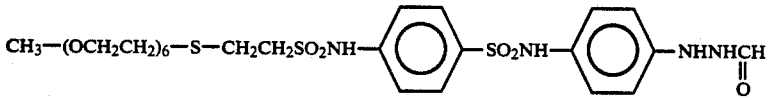
Compound 34
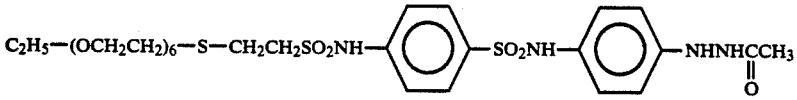
Compound 35
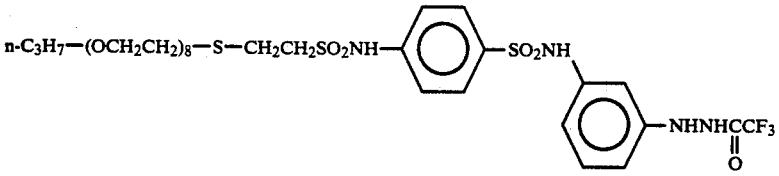
Compound 36
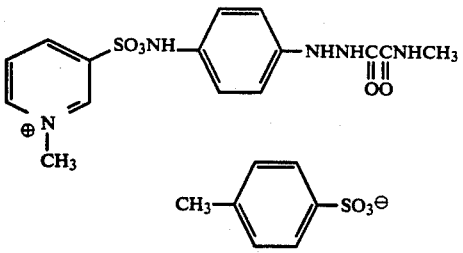
Compound 37
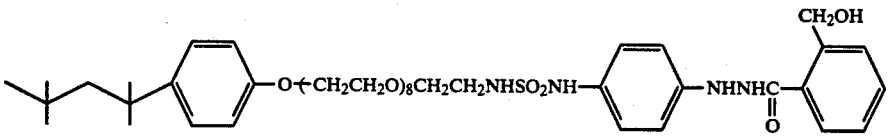
Compound 38
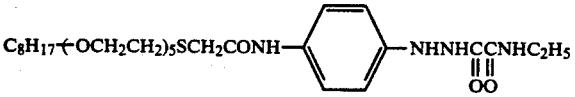

-continued

Compound 39

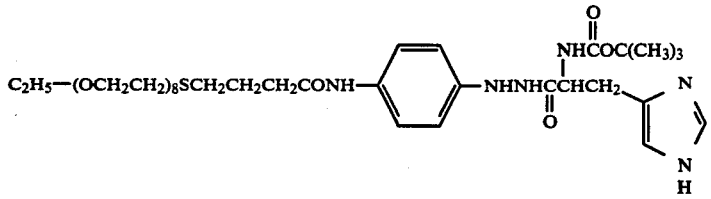

Compound 40

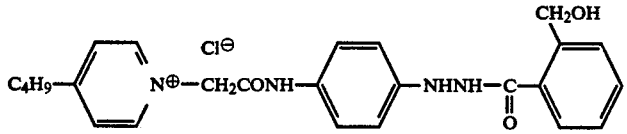

Compound 41

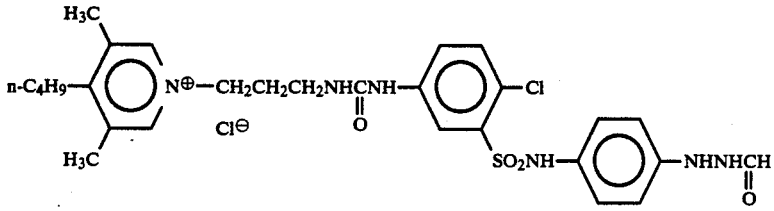

Compound 42

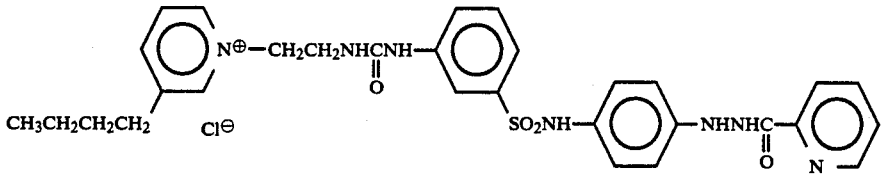

Compound 43

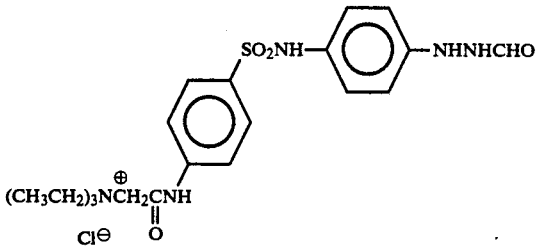

The compounds of general formula (I) according to the present invention are used in an amount of preferably $1\times10^{-6}$ to $5\times10^{-2}$ mol, particularly preferably $1\times10^{-5}$ to $2\times10^{-2}$ mol, per mol of silver halide in the emulsion layer when the compound is contained in the emulsion layer or in the emulsion layer(s) adjacent to the hydrophilic colloid layer when the compound is contained in the hydrophilic colloid layer.

The compound of general formula (I) can be incorporated in the same manner as compound of general formulas (II) and (III), which re described hereinafter.

The compounds of general formula (II) are illustrated below.

The group which is adsorbed to silver halide, represented by Y includes those derived from nitrogen-containing heterocyclic compounds.

When Y is a group derived from a nitrogen-containing heterocyclic compound, the compounds of general formula (II) are represented by the following general formula (II-a):

(II-a)

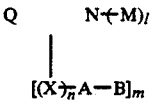

wherein l represent 0 or 1; m represents 1, 2 or 3; n represents 0 or 1; $[(X)_n—A—B]_m$ is as defined above in general formula (II); and Q represents an atomic group required for forming a five-membered or six-membered heterocyclic ring comprising at least one carbon atom and the nitrogen atom shown in formula (II-a), the ring may further contain atoms selected from a carbon, nitrogen, oxygen and sulfur atoms, and the heterocyclic ring may be fused with an aromatic carbon ring such as benzene ring or a heteroaromatic ring such as 5- to 6-membered heterocyclic ring containing at least one of N, O and S atoms as heteroatom.

Examples of the heterocyclic ring formed by Q with the nitrogen atom include an indazole ring, a benzimidazole ring, a benztriazole ring, a benzoxazole ring, a benzthiazole ring, an imidazole ring, a thiazole ring, an oxazole ring, a triazole ring, a tetrazole ring, an azaindene ring, a pyrazole ring, an indole ring, a triazine ring, a pyrimidine ring, a pyridine ring and a quinoline ring. These rings may be substituted or unsubstituted.

M represents an alkali metal atom (e.g., sodium atom, potassium atom), an ammonium group (e.g., trimethylammonium group, dimethylbenzylammonium group) or a group which is converted into H or an alkali metal atom under alkaline conditions (e.g., acetyl group, cyanoethyl group, methanesulfonylethyl group).

Further, the heterocyclic rings may be substituted by one or more of a nitro group, a halogen atom (e.g., chlorine atom, bromine atom), a mercapto group, a cyano group, an alkyl group (e.g., methyl group, ethyl group, propyl group, t-butyl group, cyanoethyl group, methoxyethyl group, methylthioethyl group), an aryl group (e.g., phenyl group, 4-methanesulfonamidophenyl group, 4-methylphenyl group, 3,4-dichlorophenyl group, naphthyl group), an alkenyl group (e.g., allyl group), an aralkyl group (e.g., benzyl group, 4-methylbenzyl group, phenethyl group), an alkoxy group (e.g., methoxy group, ethoxy group), an aryloxy group (e.g., phenoxy group, 4-methoxyphenoxy group), an alkylthio group (e.g., methylthio group, ethylthio group, methoxyethylthio group), an arylthio group (e.g., phenylthio group), a sulfonyl group (such as an alkyl- and aryl-sulfonyl group, e.g., methanesulfonyl group, ethanesulfonyl group, p-toluenesulfonyl group), a carbamoyl group (e.g., unsubstituted carbamoyl group, methylcarbamoyl group, phenylcarbamoyl group), a sulfamoyl group (e.g., unsubstituted sulfamoyl group, methylsulfamoyl group, phenylsulfamoyl group), a carbonamido group (such as an alkyl- and aryl-carbonamido group, e.g., acetamido group, benzamido group), a sulfonamido group (such as an alkyl- and aryl-sulfonamido group, e.g., methanesulfonamido group, benzenesulfonamido group, p-toluenesulfonamido group), an acyloxy group (e.g., acetyloxy group, benzoyloxy group), a sulfonyloxy group (such as an alkyl- and aryl-sulfonyloxy group, e.g., methanesulfonyloxy group), a ureido group (e.g., unsubstituted ureido group, methylureido group, ethylureido group, phenylureido group), a thioureido group (e.g., unsubstituted thioureido group, methylthioureido group), an acyl group (e.g., acetyl group, benzoyl group), a heterocyclic group, preferably a 5- to 6-membered ring having at lest one of N, O and S atoms (e.g., 1-morpholino group, 1-piperidino group, 2-pyridyl group, 4-pyridyl group, 2-thienyl group, 1-pyrazolyl group, 1-imidazolyl group, 2-tetrahydrofuryl group, tetrahydrothienyl group), an oxycarbonyl group (such as an alkyl- and aryl-oxycarbonyl group, e.g., methoxycarbonyl group, phenoxycarbonyl group), an oxycarbonylamino group (such as an alkyl- and aryl-oxycarbonyloxy group, e.g., methoxycarbonylamino group, phenoxycarbonylamino group, 2-ethylhexyloxycarbonylamino group), an amino group (e.g., unsubstituted amino group, dimethylamino group, methoxyethylamino group, anilino group), —COOM', —$SO_3$M' (wherein M' represents a hydrogen atom, an alkali metal atom, such as Na and K and $NH_4$) and a hydroxy group. These groups may be further substituted with at least one of these groups as shown as examples herein.

Examples of the bivalent bonding group represented by X include —S—, —O—, —N($R_1$)—, —C(O)O—, —OC(O)—, —C(O)N($R_2$)—, —N($R_3$)C(O)—, —$SO_2$N($R_4$)—, —N($R_5$)$SO_2$—, —N($R_6$)C(O)N($R_7$)—, —N($R_8$)C(S)N($R_9$)—, —N($R_{10}$)C(O)O—, —$SO_2$—, —C(O)—, —(O)S(O)O—, —O(O)S(O)—. These bonding groups may be bonded to Q through a straight-chain or branched alkylene group (e.g., methylene group, ethylene group, propylene group, butylene group, hexylene group, 1-methylentylene group). $R_1$, $R_2$, $R_3$, $R_4$, $R_5$, $R_6$, $R_7$, $R_8$, $R_9$ and $R_{10}$ each represents a hydrogen atom, a substituted or unsubstituted alkyl group (e.g., methyl group, ethyl group, propyl group, n-butyl group), a substituted or unsubstituted aryl group (e.g., phenyl group, 2-methylphenyl group), a substituted or unsubstituted alkenyl group (e.g., propenyl group, 1-methylvinyl group) or a substituted or unsubstituted aralkyl group (e.g., benzyl group, phenethyl group).

A represents a bivalent bonding group. Examples of the bivalent bonding group include a straight-chain or branched alkylene group (e.g., methylene group, ethylene group, propylene group, butylene group, hexylene group, 1-methylethylene group), a straight-chain or branched alkenylene group (e.g., vinylene group, 1-methylvinylene group), a straight-chain or branched aralkylene group (e.g., benzylidene group), an arylene group (e.g., phenylene, naphthylene), and a combination of at least one of these groups with at least one of bivalent bonding groups represented by X.

The substituted or unsubstituted amino group represented by B is a group represented by the following general formula (II-b):

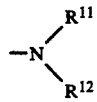

(II-b)

wherein $R^{11}$ and $R^{12}$ may be the same or different and each represents a hydrogen atom, a substituted or unsubstituted alkyl group having 1 to 30 carbon atoms (including carbon atoms of the substituent), a substituted or unsubstituted alkenyl group or a substituted or unsubstituted aralkyl group. These groups may be straight-chain (e.g., methyl group, ethyl group, n-propyl group, n-butyl group, n-octyl group, allyl group, 3-butenyl group, benzyl group, 1-naphthylmethyl group), branched (e.g., isopropyl group, t-octyl group) or cyclic (e.g., cyclohexyl group).

$R^{11}$ and $R^{12}$ may be combined together to form a saturated or unsaturated hetero ring, or may be cyclized so as to form a saturated hetero ring further having, as a member of the ring, at least one hetero-atom (e.g., oxygen atom, sulfur atom, nitrogen atom). Examples of the ring include a pyrrolidyl group, a piperidyl group and a morpholino group.

Examples of the substituent groups for $R^{11}$ and $R^{12}$ include —COOM', —$SO_3$M' (wherein M' represents a hydrogen atom, an alkali metal atom such as Na and K, and $NH_4$), a cyano group, a halogen atom (e.g., fluorine atom, chlorine atom, bromine atom), a hydroxyl group, an alkoxycarbonyl group and an aryloxycarbonyl group having not more than 20 carbon atoms (e.g., methoxycarbonyl group, ethoxycarbonyl group, phenoxycarbonyl group, benzyloxycarbonyl group), an alkoxy group having not more than 20 carbon atoms (e.g., methoxy group, ethoxy group, benzyloxy group, phenethyloxy group), a monocyclic aryloxy group having not more than 20 carbon atoms (e.g, phenoxy group, p-tolyloxy group), an acyloxy group having not more than 20 carbon atoms (e.g., acetyloxy group, propionyloxy group), an acyl group having not more than 20 carbon atoms (e.g., acetyl group, propionyl group, benzoyl group, mesyl group), a carbamoyl group (e.g., carbamoyl group, N,N-dimethylcarbamoyl group, morpholinocarbonyl group, piperidinocarbonyl group), a sulfamoyl group (e.g., sulfamoyl group, N,N-dimethylsulfamoyl group, morpholinosulfonyl group, piperidinosulfonyl group), an acylamino group having not more than 20 carbon atoms (e.g., acetylamino group, propionylamino group, benzoylamino group, mesylamino group), a sulfonamido group (e.g., ethylsulfonamido group, p-toluenesulfonamido group), a carbonamido group having not more than 20 carbon atoms (e.g., methylcarbonamido group, phenylcarbonamido group), a ureido group having not more than 20 carbon atoms (e.g., methylureido group, phenylureido group) and an amino group. These groups may be further substituted with at least one of these substituents.

The ammonium group represented by B is a group represented by the following general formula (II-c):

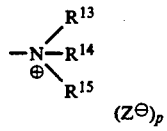

(II-c)

wherein $R^{13}$, $R^{14}$ and $R^{15}$ have the same meaning as $R^{11}$ and $R^{12}$ in general formula (II-b); $Z^{\ominus}$ represents an anion such as a halide ion (e.g., $Cl^{\ominus}$, $Br^{\ominus}$, $I^{\ominus}$), a sulfonate ion (e.g., trifluoromethanesulfonate ion, p-toluenesulfonate ion, benzenesulfonate ion, p-chlorobenzenesulfonate ion), a sulfate ion (e.g., ethylsulfate ion, methylsulfate ion), perchlorate ion or tetrafluoroborate ion; and p represents 0 or 1 and when the compound forms an inner salt, p is 0 and at least one of $R^{13}$, $R^{14}$ and $R^{15}$ has an anion (e.g., $-SO_3^{\ominus}$, $-COO^{\ominus}$).

The nitrogen-containing heterocyclic ring represented by B is a five-membered or six-membered ring having at least one nitrogen atom as a member of the ring. The heterocyclic ring may have further at least one of N, O and S atoms as hetero-atom. The ring may be substituted or fused with another ring. Examples of the nitrogen-containing heterocyclic ring include an imidazolyl ring, a pyridyl ring and a thiazolyl ring. The heterocyclic ring may be bonded through any atom in the ring to A in formula (II).

Among the compounds of general formula (II), compounds represented by the following general formula (II-m), (II-n), (II-o) or (II-p) are preferred:

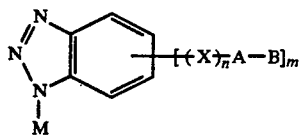

(II-m)

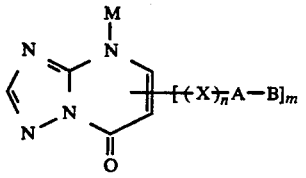

(II-n)

-continued

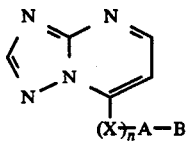

(II-o)

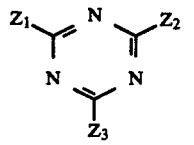

(II-p)

wherein $-(X)_n-A-B$, M and m are as defined above in general formula (II-a); and $Z_1$, $Z_2$ and $Z_3$ have the same meaning as $-(X)_n-A-B$ in general formula (II-a) or each represents a halogen atom, an alkoxy group having preferably 1 to 20 carbon atoms (e.g., methoxy group), a hydroxy group, a hydroxyamino group or a substituted or unsubstituted amino group preferably having 0 to 20 carbon atoms [examples of substituents include those already described above in the definition of the substituent groups for $R^{11}$ and $R^{12}$ in general formula (II-b)] provided that at least one of $Z_1$, $Z_2$ and $Z_3$ has the same meaning as $-(X)_n-A-B$.

These heterocyclic rings may be substituted by one or more of substituent groups which can be applied to the heterocyclic rings in general formula (II).

Examples of the compounds of general formula (II) which can be used in the present invention include, but are not limited to, the following compounds:

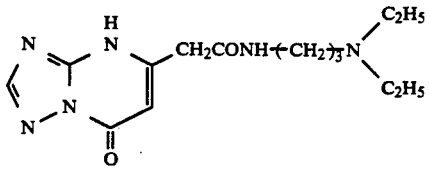

II-1

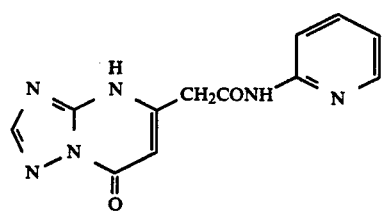

II-2

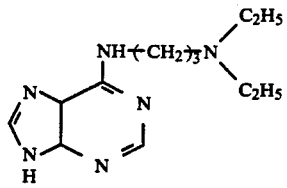

II-3

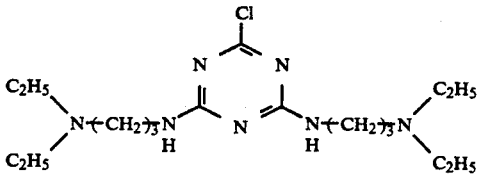

II-4

-continued

II-5

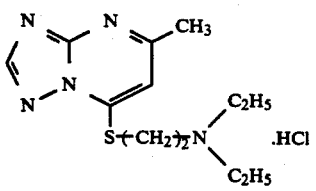

II-6

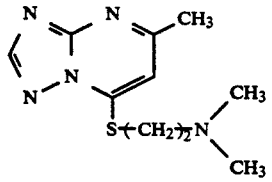

II-7

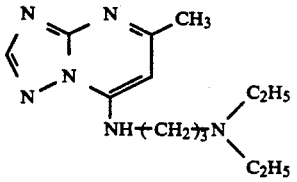

II-8

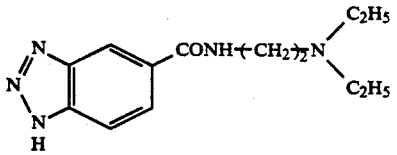

II-9

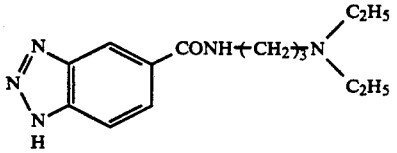

II-10

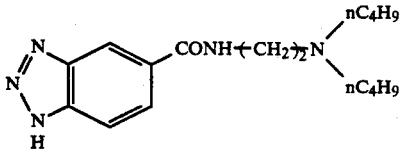

II-11

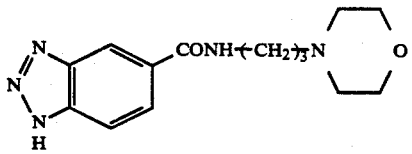

II-12

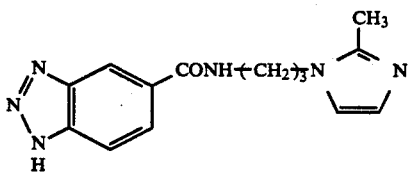

II-13

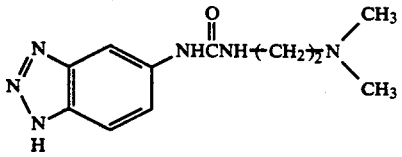

-continued

II-14

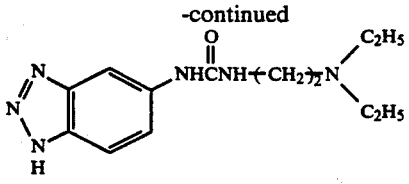

II-15

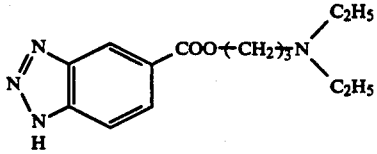

II-16

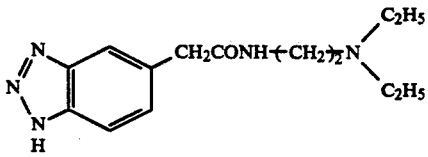

II-17

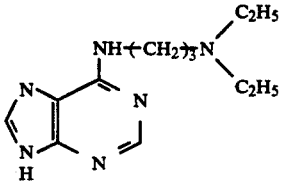

II-18

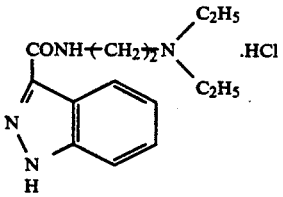

II-19

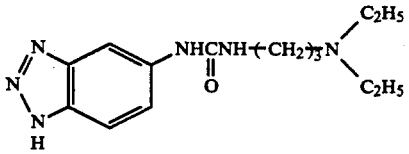

The compounds of general formula (III) are illustrated below.

In general formula (III), $R^1$ and $R^2$ each represents a hydrogen atom or an aliphatic group, and $R^1$ and $R^2$ may be combined together to form a ring; $R^3$ represents a bivalent aliphatic group; X represents a bivalent heterocyclic ring having at least one of nitrogen, oxygen and sulfur atoms as a member of the ring; n represents 0 or 1; and M represents a hydrogen atom, an alkali metal atom, an alkaline earth metal atom, a quaternary ammonium, a quaternary phosphonium or an amidino group, and x is 1 when M represents a monovalent atom or group and x is ½ when M represents a divalent atom; said compound may be in the form of an addition salt.

The aliphatic group represented by $R^1$ and $R^2$ includes an alkyl group having 1 to 12 carbon atoms, an alkenyl group having 1 to 12 carbon atoms and an alkynyl group having 1 to 12 carbon atoms. Examples of the alkyl group include a methyl group, an ethyl group, a propyl group, a butyl group, a hexyl group, a decyl group, a dodecyl group, an isopropyl group, a sec-butyl group and a cyclohexyl group. Examples of the alkenyl group include an allyl group, a 2-butenyl group, a 2-hexenyl group and a 2-octenyl group. Examples of the alkynyl group include a propargyl group and a 2-pentynyl group. These groups may be substituted. Examples of the substituent groups include a phenyl group, a substituted phenyl group, an alkoxy group, an alkylthio group, a hydroxy group, —COOM'$_y$, —SO$_3$M'$_y$ (wherein M' represents a hydrogen atom, an alkali metal atom such as Li, K and Na, $NH_4$ and an alkaline earth metal atom such as Ca and Mg; and y is 1 when M' represents a monovalent atom or group, and y is ½ when M' represents a divalent atom), an alkylamino group and an amido group.

When $R^1$ and $R^2$ are combined together to form a ring, the ring is a five-membered or six-membered heterocyclic ring and it may further contain at least one of nitrogen and oxygen atom as a member of the ring, with a saturated ring being preferred. Examples of the heterocyclic ring include pyrrolidyl, piperidyl, morpholino, piperazyl and 4-methylpiperazyl.

Particularly preferably, $R^1$ and $R^2$ are each an alkyl group having 1 to 3 carbon atoms, with ethyl group being more preferred.

The bivalent aliphatic group represented by $R^3$ is preferably —$R^4$— or —$R^4$S— wherein $R^4$ is a bivalent aliphatic group and preferably a saturated or unsaturated aliphatic group having 1 to 6 carbon atoms. Examples of $R^4$ include —$CH_2$—, —$CH_2CH_2$—, —$(CH_2)_3$—, —$(CH_2)_4$—, —$(CH_2)_6$—, —$CH_2CH{=}CHCH_2$—, —$CH_2C{=}CCH_2$—, and —$CH_2$ $CH(CH_3)CH_2$—.

$R^4$ has preferably 2 to 4 carbon atoms. More preferably, $R^4$ is —$CH_2CH_2$— or —$CH_2CH_2CH_2$— and when n of $(X)_n$ is 0, $R^3$ is $R^4$.

The heterocyclic ring represented by X is a five-membered or six-membered heterocyclic ring having the nitrogen atom or having further at least one of hetero-atom of nitrogen, oxygen and sulfur. The ring may be fused with a benzene ring. An aromatic heterocyclic ring is preferred. Preferred examples thereof include tetrazole, triazole, thiadiazole, oxadiazole, imidazole, thiazole, oxazole, benzimidazole, benzthiazole and benzoxazole. Among them, tetrazole and thiadiazole are particularly preferred.

The heterocyclic ring is bonded to $R_3$ and S through any atom in the ring.

Examples of substituents of the heterocyclic ring are an alkyl group having 1 to 20 carbon atoms and an aryl group having 6 to 10 carbon atoms such as a phenyl group.

Examples of the alkali metal ion represented by M include $Na^+$, $K^+$, and $Li^+$.

Examples of the alkaline earth metal ion include $Ca^{++}$ and $Mg^{++}$.

The quaternary ammonium represented by M has 4 to 30 carbon atoms. Examples of the quaternary ammonium ion include $(CH_3)_4N^+$, $(C_2H_5)_4N^+$, $(C_4H_9)_4N^+$, $C_6H_5CH_2N^+(CH_3)_3$ and $C_{16}H_{33}N^+(CH_3)_3$. Examples of the quaternary phosphonium ion include $(C_4H_9)_4P^+$, $C_{16}H_{33}P^+(CH_3)_3$ and $C_{16}H_{33}CH_2P^+(CH_3)$.

Examples of the inorganic acid addition salts of the compounds of general formula (III) include hydrochloride, sulfate and phosphate. Examples of the organic acid addition salts thereof include acetate, propionate, methanesulfonate, benzenesulfonate and p-toluenesulfonate.

Examples of the compounds of general formula (III) include the following compounds:

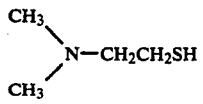
III-1

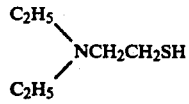
III-2

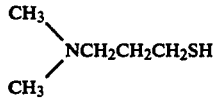
III-3

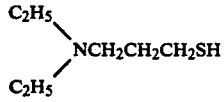
III-4

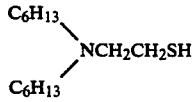
III-5

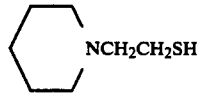
III-6

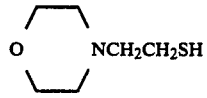
III-7

$(HOCH_2CH_2)_2NCH_2CH_2SH$ III-8

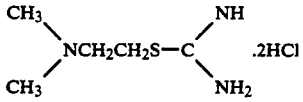
III-9

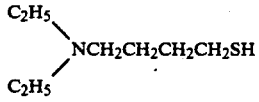
III-10

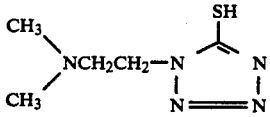
III-11

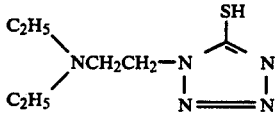
III-12

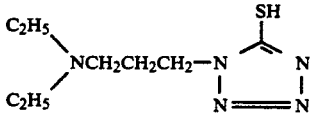
III-13

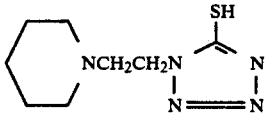
III-14

-continued

III-15

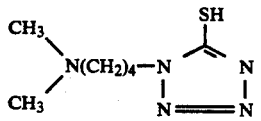

III-16

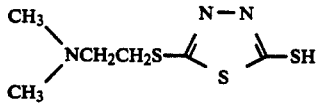

III-17

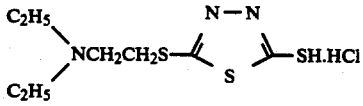

III-18

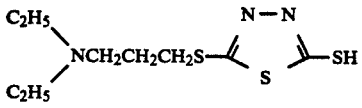

III-19

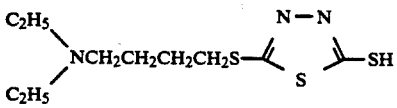

III-20

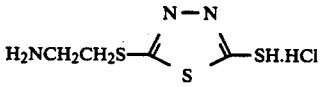

III-21

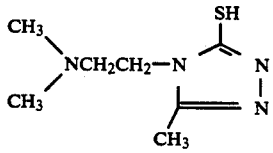

III-22

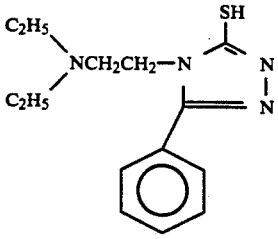

The compounds represented by general formulas (II) and (III) may be synthesized according on the method disclosed in, for example, U.S. Pat. No. 4,851,321.

The optimum total amounts of the compounds of general formulas (II) and (III) vary depending on the type of the compounds, but are generally in the range of $1.0\times10^{-3}$ to 0.5 g/m$^2$, preferably $5.0\times10^{-3}$ to 0.3 g/m$^2$. These compounds are dissolved in an appropriate solvent (e.g., $H_2O$, an alcohol such as methanol or ethanol, acetone, dimethylformamide, methyl cellosolve) and added to the coating solutions.

These additives may be used either alone or in combination of two or more of them.

Each of compounds represented by (I) to (III) may be incorporated either into a silver halide emulsion layer or adjacent hydrophilic colloid layer(s) to the emulsion layer such as an interlayer, a protective layer, an antihalation layer, an irradiation inhibiting layer and/or an undercoating layer.

These compound may be incorporated into the same layer or into separate layers.

Additives, processing methods, etc., described in the following patent specifications can be preferably applied to the light-sensitive materials of the present invention without particular limitation.

| | Item | Applicable Disclosure |
|---|---|---|
| (1) | Silver halide emulsion and preparation thereof | The 12th line of right lower column of page 20 to the 14th line of left lower column of page 21 of JP-A-2-97937; the 19th line of right upper column of page 7 to the 12th line of left lower column of JP-A-2-12236; and selenium sensitizing method described in EP514675A |
| (2) | Spectral sensitizing dye | The 13th line of left lower column of page 8 to the 4th line of right lower column of page 8 of JP-A-2-12236; the third line of right lower column of page 16 to the 20th line of left lower column of page 17 of JP-A-2-103535; and spectral sensitizing dyes described in JP-A-1-112235, JP-A-2-124560, JP-A-3-7928, EP514675A and Japanese Patent Application 3-411064. |
| (3) | Surfactant | The 7th line of right upper column of page 9 to the 7th line of right lower column of page 9 of JP-A-2-12236; the 13th line of left lower column of page 2 to the 18th line of right lower column of page 4 of JP-A-2-18542. |
| (4) | Anti-fogging agent | The 19th line of right lower column of page 17 to the 4th line of right upper column of page 18 of JP-A-2-103536; the first line to the 5th line of right lower column of page 18 of JP-A-2-103536; and thiosulfinic acid compounds described in JP-A-1-237538. |
| (5) | Polymer latex | The 12th line to the 20th line of left lower column of page 18 of JP-A-2-103536. |
| (6) | Compound having an acid group | The 6th line of right lower column of page 18 to the first line of left upper column of page 19 of JP-A-2-103536. |
| (7) | Matting agent, lubricant, plasticizer | The 15th line of left upper column of page 19 to the 15th line of right upper column of page 19 of JP-A-2-103536. |
| (8) | Hardening agent | The 5th line to the 17th line of right upper column of page 18 of JP-A-2-103536. |
| (9) | Dye | Dyes described in JP-A-2-103536 (the first line to the 18th line of right lower column of page 17); and solid dyes described in JP-A-2-294638 and JP-A-5-11382. |
| (10) | Binder | The first line to the 20th line of right lower column of page 3 of JP-A-2-18542 |
| (11) | Black pepper inhibitor | Compounds described in U.S. Pat. No. 4,956,257 and JP-A-1-118832 |
| (12) | Redox compound | Compounds (particularly compounds 1 to 50) of general formula (I) of JP-A-2-301743; compounds 1 to 75, compounds of general formulas (R-1), (R-2) and (R-3) of JP-A-3-174143 (pages 3 to 20); and compounds described in Japanese Patent |

-continued

| | Item | Applicable Disclosure |
|---|---|---|
| | | Application Nos. 3-69466 and 3-15648. |
| (13) | Monomethine compound | Compounds (particularly compounds II-1 to II-26) of general formula (II) of JP-A-2-287532 |
| (14) | Dihydroxybenzenes | Compounds described in JP-A-3-39948 (left upper column of page 11 to left lower column of page 12) and EP 452,772A |
| (15) | Developing solution and development method | The 16th line of right upper column of page 19 to the 8th line of left upper column of page 21 of JP-A-2-103536. |

The photographic material of the present invention is preferably processed with a developer having a pH of from 9.6 to 11.0. The effects of the present invention can be obtained without using any amino compound, such as $$(n)C_4H_9-N(C_2H_4OH)_2,\ HOCH_2\overset{OH}{\overset{|}{C}}CH_2-N(C_2H_5)_2 \text{ and}$$

$$HOC_6H_{12}-N(CH_3)_2,$$

which has a nucleation accelerating characteristic and which is used as a nucleation accelerator in a developer.

The present invention is now illustrated in greater detail by reference to the following examples which, however, are not to be construed as limiting the present invention in any way.

EXAMPLE 1

Preparation of Silver Halide Emulsion

Emulsion A

An aqueous solution of 0.37 mol of silver nitrate and an aqueous halide solution containing 0.15 mol of potassium bromide, 0.23 mol of sodium chloride, $1.0\times10^{-7}$ mol (per mol of silver in the resulting finished emulsion) of $(NH_4)_3RhCl_6$ and $2\times10^{-7}$ mol (per mol of silver in the resulting finished emulsion) of $K_3IrCl_6$ were added to an aqueous gelatin solution containing sodium chloride and 1,3-dimethyl-2-imidazolidinethione with stirring at 45° C. over a period of 12 minutes by means of the double jet process to obtain silver chlorobromide grains having a mean grain size of 0.20 μm and a silver chloride content of 60 mol %, thus resulting in nucleation. Subsequently, an aqueous solution of 0.63 mol of silver nitrate and an aqueous halide solution containing 0.25 mol of potassium bromide and 0.41 mol of sodium chloride were added thereto over a period of 20 minutes by means of the double jet process. Further, $1\times10^{-3}$ mol (per mol of silver) of KI solution was added thereto to thereby carry out conversion. The emulsion was then washed with water by a conventional flocculation method, and 40 g of gelatin was added thereto. The pH of the emulsion was adjusted to 6.5, and the pAg thereof was adjusted to 7.5. Subsequently, 7 mg of sodium benzenethiosulfonate, 5 mg of sodium thiosulfate and 8 mg of chloroauric acid (each is per mol of silver) were added thereto. The emulsion was heated at 60° C. for 45 minutes to carry out chemical sensitization. Further, 150 mg of 4-hydroxy-6-methyl-1,3,3a,7-tetrazaindene as a stabilizer and the following compound Proxel as an antiseptic were added thereto;

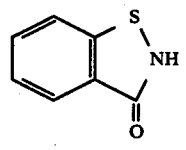

The resulting grains were silver chlorobromide cubic grains having a mean grain size of 0.28 μm and a silver chloride content of 60 mol % (a coefficient of variation: 9%).

Preparation of Coated Sample

The following layers in order of the emulsion and the protective layers from the side of the support were coated on a polyethylene terephthalate film (thickness: 150 μm) support having an undercoat layer (thickness: 0.5 μm) comprising a vinylidene chloride copolymer to prepare Sample Nos. 101 to 112.

Each layer was prepared in the following manner and the coating weight thereof was as follows.

Emulsion Layer

The above Emulsion A together with gelatin was dissolved at 40° C. To the resulting solution, there were added sensitizing dye S-1 ($3.6\times10^{-4}$ mol/mol Ag), the following Compound (a) (2.5 mg/m$^2$), 2,6-dihydroxylamino-4-N,N-diethylamino-1,3,5-triazine (2.0 mg/m$^2$), 8-chloro-5-hydroxyquinoline (5 mg/m$^2$), the following Compound (b) (50 mg/m$^2$), 20 wt % (based on the amount of gelatin) of polyethyl acrylate, 15 wt % (based on the amount of gelatin) of the following Compound (d), 3.8 wt % (based on the amount of gelatin) of the following Compound (c) and the compounds of general formulas (I), (II) and (III) as indicated in Table 1. The resulting emulsion was coated on the support in such an amount as to give a coating weight of 3.6 g/m$^2$ in terms of silver. The coating weight of gelatin was 1.8 g/m$^2$.

Compounds used in Example 1:

Sensitizing dye S-1

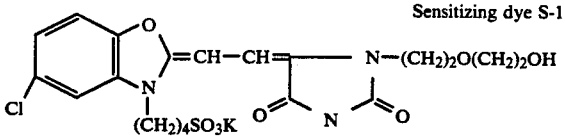

Compound (a)

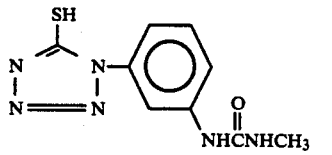

Compound (b)

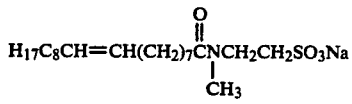

Compound (c)

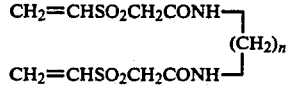

3:1 (by weight) mixture of n = 2 and n = 3

-continued

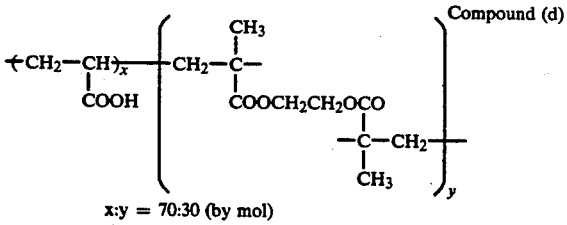

Compound (d)

x:y = 70:30 (by mol)

-continued

| Formulation of developinq solution | |
|---|---|
| Add water to make | one liter (pH = 10.5) |

TABLE 1

| Sample No. | Formula (I) Type | Formula (I) Amount added | Formula (II) or (III) Type | Formula (II) or (III) Amount added (mg/m²) | Fresh γ | Fresh Practical $D_m$ | Fresh Black pepper | One week γ | One week Practical $D_m$ | One week Black pepper | Remarks |
|---|---|---|---|---|---|---|---|---|---|---|---|
| 101 | — | — | — | — | 7.0 | 4.16 | OK | 6.8 | 3.88 | OK | Comparison |
| 102 | I-21 | $1 \times 10^{-4}$ | — | — | 10.2 | 5.17 | OK | 8.4 | 4.08 | OK | " |
| 103 | " | " | II-9 | 11.0 | 17.6 | 5.48 | OK | 15.6 | 5.37 | OK | Invention |
| 104 | " | $2 \times 10^{-4}$ | — | — | 17.1 | 5.40 | OK | 10.7 | 4.33 | NG | Comparison |
| 105 | I-27 | $1 \times 10^{-4}$ | — | — | 11.2 | 5.12 | OK | 8.4 | 4.16 | OK | " |
| 106 | " | " | II-9 | 11.0 | 18.0 | 5.48 | OK | 16.9 | 5.40 | OK | Invention |
| 107 | " | $2 \times 10^{-4}$ | — | — | 18.4 | 5.46 | OK | 11.2 | 4.47 | NG | Comparison |
| 108 | I-28 | $1 \times 10^{-4}$ | — | — | 9.5 | 5.12 | OK | 8.0 | 4.00 | OK | " |
| 109 | " | " | II-9 | 11.0 | 16.0 | 5.40 | OK | 15.1 | 5.28 | OK | Invention |
| 110 | " | $2 \times 10^{-4}$ | — | — | 15.3 | 5.33 | OK | 10.3 | 4.43 | NG | Comparison |
| 111 | I-43 | $1 \times 10^{-4}$ | — | — | 12.8 | 5.21 | OK | 8.8 | 4.14 | OK | " |
| 112 | " | " | II-9 | 11.0 | 19.6 | 5.53 | OK | 18.0 | 5.50 | OK | Invention |
| 113 | " | $2 \times 10^{-4}$ | — | — | 20.3 | 5.50 | OK | 12.3 | 4.52 | NG | Comparison |

Note:
The amounts of the compounds of formulas (I) is mol/m² (II) and (III) in Table are g/m².
Black pepper: OK is a practically acceptable level, and the number of black pepper in sensitometry Dmin area is 0 to 3/5 × 5 mm sq. NG is practically unusable level and the number of black pepper in Dmin area is at least 4/5 × 5 mm sq.

Surface Protective Layer

A polymethyl methacrylate dispersion (average particle size: 5 μm) was added to a gelatin solution. Further, the following Surfactants (e, f) were added thereto. The coating solution was coated in such an amount as to give a gelatin coating weight of 1.0 g/m² and a coating weight of 0.5 g/m² in term of polymethyl methacrylate.

Surfactant (e) 20 mg/m²

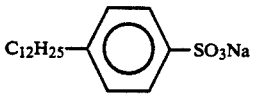

Surfactant (f) 1.5 mg/m²

$C_8F_{17}SO_2N(C_3H_7)CH_2COOK$

The following developing solution was used in this Example.

| Formulation of developinq solution | |
|---|---|
| Hydroquinone | 30.0 g |
| N-Methyl-p-aminophenol | 0.3 |
| Sodium hydroxide | 10.0 |
| Potassium sulfite | 60.0 |
| Disodium ethylenediaminetetraacetate | 1.0 |
| Sodium carbonate | 11.0 |
| Potassium bromide | 10.0 |
| 5-Methylbenztriazole | 0.4 |
| 2-Mercaptobenzimidazole-5-sulfonic acid | 0.3 |
| Sodium 3-(5-mercaptotetrazole)-benzenesulfonate | 0.2 |
| Sodium toluene sulfonate | 8.0 |
| Add water to make | one liter (pH = 10.5) |

Evaluation of Photographic Characteristics

1. Sensitometry Gradation (γ)

The samples were exposed to light through a filter having a color temperature of 3200° K. and a step wedge by using a tungsten sensitometer. The samples were then developed at 34° C. for 30 seconds, fixed rinsed and dried by using an automatic processor FG-710F manufactured by Fuji Photo Film Co., Ltd. The fixing solution used was GR-F1 manufactured by Fuji PHoto Film Co., Ltd. In another experiment, the above-described developing solution having the above formulation was put into the automatic processor, and the processor as such was allowed to stand for one week at 34° C. Subsequently, exposure and processing were carried out in the same manner as described above.

$$\gamma = \text{difference in optical density } (3.0-0.3) \div \Delta \log E$$

wherein ΔlogE is a difference between an exposure amount (logE 3.0) giving an optical density of 3.0 and an exposure amount (logE 0.3) giving an optical density of 0.3.

2: Practical Dmax

There was prepared an original wherein an image having a line width of 40 μ was formed on phototypesetting paper. The line width was measured by scanning the original in the direction of the line width with a reflection type microdensitometer. The optical density of the line was 0.6. The exposure amount was adjusted so that the line width (transparent portion) of the photographed image became 40μ, and the original was photographed by using a reflection type process camera C-690-D manufactured by Dainippon Screen KK. In the same manner as the above item 1 described above, processing was then carried out.

It is apparent from Table 1 that when the compounds of general formula (I) alone are used and the fresh solution is used, the samples exhibit such a good performance that when the amounts of the compounds are increased, gradation becomes high-contrast and Dm is high. However, when the exhaust solution (after a lapse of one week) is used, gradation becomes low-contrast and Dm is lowered. Particularly, when the amounts of the compounds of general formula (I) are increased, the formation of black pepper is increased and the samples are practically unusable. On the other hand, Sample Nos. 103, 106, 109 and 112 of the present invention have such a good performance that high contrast and high Dm can be obtained by using a small amount of the compound of general formula (I), and even when the samples are processed with the exhausted solution, high contrast and high Dm are maintained and black pepper is scarcely formed.

EXAMPLE 2

Preparation of Coated Sample

Sample Nos. 201 to 215 were prepared in the same manner as in Example 1 except that the types and amounts of the compounds of general formulas (I), (II) and (III) used in the emulsion layer were changed as indicated in Table 2.

Comparative compounds used in this Example are the following compounds.

COMPARATIVE COMPOUND USED IN EXAMPLE 2

Compound A

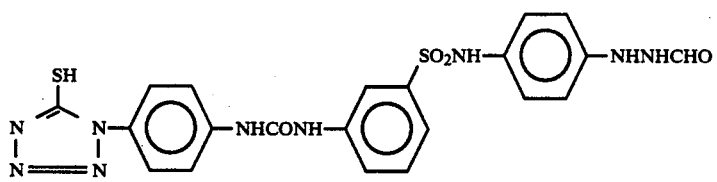

Compound B

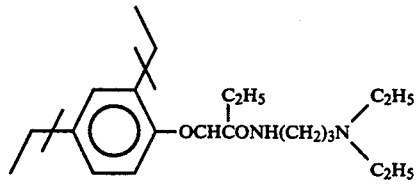

TABLE 2

| Sample No. | Compound of Formula (I), etc. Type | Amount added | Compound of Formula (II), (III), etc. Type | Amount Added mg/m² | Fresh γ | Fresh $D_m$ | One week γ | One week $D_m$ | ΔS | Remarks |
|---|---|---|---|---|---|---|---|---|---|---|
| 201 | I-36 | $1 \times 10^{-4}$ | — | — | 9.8 | 5.12 | 9.0 | 4.01 | +0.15 | Comparison |
| 202 | " | " | II-3 | 7.9 | 12.7 | 5.33 | 12.3 | 5.21 | +0.10 | Invention |
| 203 | " | " | " | 15.7 | 15.4 | 5.40 | 13.8 | 5.31 | +0.08 | " |
| 204 | " | " | II-13 | 7.4 | 15.1 | 5.37 | 13.5 | 5.27 | +0.07 | " |
| 205 | " | " | " | 14.9 | 19.6 | 5.56 | 17.5 | 5.40 | +0.05 | " |
| 206 | " | " | III-15 | 6.0 | 13.1 | 5.34 | 12.5 | 5.25 | +0.07 | " |
| 207 | " | " | " | 12.0 | 16.5 | 5.44 | 14.7 | 5.33 | +0.05 | " |
| 208 | " | " | III-19 | 8.3 | 15.5 | 5.44 | 13.9 | 5.31 | +0.09 | " |
| 209 | " | " | " | 16.7 | 18.3 | 5.49 | 16.0 | 5.38 | +0.07 | " |
| 210 | " | " | Compound B | 26.0 | 10.1 | 5.20 | 9.2 | 4.04 | +0.17 | Comparison |
| 211 | " | " | " | 86.5 | 10.5 | 5.25 | 9.5 | 4.15 | +0.19 | " |
| 212 | Compound A | $8 \times 10^{-6}$ | — | — | 12.0 | 5.40 | 9.8 | 4.15 | +0.25 | " |
| 213 | " | $2 \times 10^{-5}$ | — | — | 10.7 | 5.00 | 9.5 | 4.10 | +0.31 | " |
| 214 | " | $8 \times 10^{-6}$ | II-9 | 8.3 | 15.2 | 5.40 | 12.2 | 4.89 | +0.22 | " |
| 215 | " | " | " | 16.5 | 16.5 | 5.44 | 13.0 | 5.06 | +0.18 | " |

Note:
ΔS is a difference in sensitivity between fresh and 1 week.
The logarithm of the reciprocal of an exposure amount giving a density of 1.5 in sensitometry is referred to as sensitivity.
The mark + in ΔS means sensitization, and the mark − means desensitization.

It is apparent from Table 2 that when Sample Nos. 210 and 211 are processed with fresh solution, an effect of providing high contrast is small, and when the samples are processed with the exhausted solution, they are sensitized and become low-contrast. Sample Nos. 214 and 215 show high contrast and high Dm when processed with fresh solution as well as exhausted solution (after a lapse of one week), but the degree of sensitization is high when processed with the exhausted solution.

On the other hand, any of Sample Nos. 202 to 209 of the present invention can maintain high contrast and high Dm when processed with fresh solution as well as exhausted solution (after a lapse of one week). The samples scarcely cause the fluctuation of sensitivity when processed with the exhausted solution, and hence the samples of the present invention have good stability.

It will be understood that according to the present invention there can be obtained a silver halide photographic material which gives an ultra-high contrast negative image having a gamma value of at least 10 by using a stable developing solution having a pH of not higher than 11.0.

While the present invention has been described in detail and with reference to specific embodiments thereof, it is apparent to one skilled in the art that various changes and modifications can be made therein without departing from the spirit and the scope of the present invention.

What is claimed is:

1. A silver halide photographic material comprising a support having thereon at least one light-sensitive silver halide emulsion layer, wherein at least one of the silver halide emulsion layer and a hydrophilic colloid layer(s) adjacent thereto contains at least one hydrazine compound represented by the following general formula (I) and at least one compound selected from the group consisting of compounds represented by the following general formula (II) or (III):

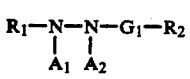

(I)

wherein $R_1$ represents an aliphatic or aromatic group which has a substituent having a moiety of $—O(CH_2CH_2O)_n—$, $—O—(CH_2CH(CH_3)O)_n—$ or $—O—(CH_2CH(OH)CH_2O)_n—$ (wherein n is an integer of not smaller than 3) as part of a substituent or having a moiety of a quaternary ammonium cation as part of a substituent group, $G_1$ represents a bivalent bonding group consisting of at least one of —CO—, —COCO—, —CS—, $—C(=NG_2R_2)—$, —SO—, $—SO_2—$ or $—P(O)(G_2R_2)—$; $G_2$ represents a single bond, —O—, —S— or $—N(R_2)—$; $R_2$ represents an aliphatic group, an aromatic group or a hydrogen atom, and when there are two or more $R_2$ groups, they may be the same or different; and one of $A_1$ and $A_2$ is a hydrogen atom, and the other is a hydrogen atom, an acyl group or an alkyl- or arylsulfonyl group, when $R_1$ contains said quaternary ammonium cation, the compound further has a counter anion or has an anion group at $R_1$ to form an inner salt;

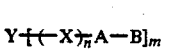

(II)

wherein Y represents a group which is adsorbed to silver halide; X represents a bivalent bonding group comprising an atom or atoms selected from hydrogen, carbon, nitrogen, oxygen and sulfur atoms; A represents a bivalent bonding group; B represents an amino group which may be substituted, an ammonium group or a nitrogen-containing heterocyclic ring; m represents 1, 2 or 3; and n represents 0 or 1; and said compounds represented by formula (II) are represented by formula (II-m), (II-n), or (II-o):

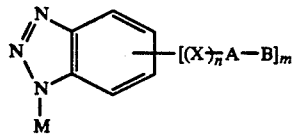

(II-m)

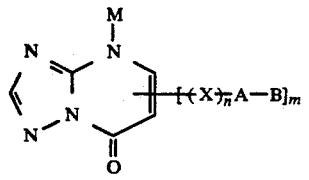

(II-n)

-continued

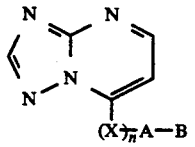

(II-o)

wherein M represents an alkali metal atom, an ammonium group or a group which is converted into H or an alkali metal atom under alkaline conditions; $—(X)_n—A—B$ and m are as defined in formula (II); and wherein the heterocyclic rings in the formulas may be substituted by one or more of substituent groups;

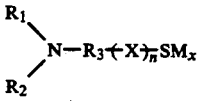

(III)

wherein $R_1$ and $R_2$ each represents a hydrogen atom or an aliphatic group, or $R_1$ and $R_2$ may be combined together to form a ring; $R_3$ represents a bivalent aliphatic group; X represents a bivalent heterocyclic ring having at least one of hetero-atom of nitrogen, oxygen and sulfur atoms; n represents 0 or 1; and M represents a hydrogen atom, an alkali metal atom, an alkaline earth metal atom, a quaternary ammonium, a quaternary phosphonium or an amidino group; x is 1 when M represents a monovalent atom or group and x is ½ when M represents a divalent atom; said compound may be in the form of an addition salt.

2. The silver halide photographic material as in claim 1, wherein said substituent for $R_1$ of general formula (I) is at least one of an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, $—SO_3M'_y$, $—COOM'_y$ (wherein M' represents a hydrogen atom, an alkali metal atom, $NH_4$, and an alkaline earth metal atom; y is 1 when M' represents a monovalent atom or group, and y is ½ when M' represents a divalent atom), an aryloxycarbonyl group, an acyl group, an a alkoxycarbonyl group, an acyloxy group, a carbonamido group, a sulfonamido group, and a phosphoric acid amido group.

3. The silver halide photographic material as in claim 1, wherein $R_2$ of general formula (I) is substituted with at least one of substituents selected from the group consisting of an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, $—SO_3M'_y$, $—COOM'_y$ (wherein M' represents a hydrogen atom, an alkali metal atom, $NH_4$, and an alkaline earth metal atom; y is 1 when M' represents a monovalent atom or group and y is ½ when M' represents a divalent atom), an aryloxycarbonyl group, an acyl group, an alkoxycarbonyl group, an acyloxy group, a carbonamido group, a sulfonamido group, a phosphoric acid amido group, and a nitrogen containing aromatic ring which may be fused with a benzene ring or a heterocyclic ring.

4. The silver halide photographic material as in claim 1, wherein $R_1$ of general formula (I) and $R_2$ of general formula (I) each has at least one of a ballast group and an adsorption enhancing group to silver halide grains.

5. The silver halide photographic material as in claim 1, wherein $R_1$ of general formula (I) is a group represented by the following general formula (Ia), (Ib), (Ic) or (Id):

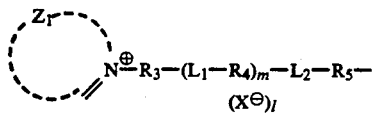

(Ia)

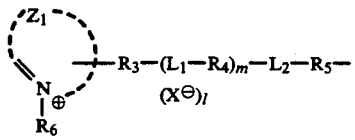

(Ib)

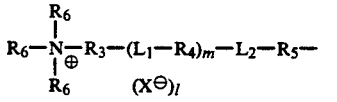

(Ic)

$$R_6-O-(L_3)_n-R_3-(L_1-R_4)_m-L_2-R_5- \quad \text{(Id)}$$

wherein $L_1$ and $L_2$ each represents —$CONR_7$—, —$NR_7CONR_8$—, —$SO_2$—$NR_7$— or —$NR_7SO_2NR_8$—; $R_7$ and $R_8$ each represents a hydrogen atom, an alkyl group having 1 to 6 carbon atoms or an aryl group having 6 to 10 carbon atoms; and l and m each represents 0 or 1; $R_3$ and $R_4$ each represents a bivalent aliphatic group, aromatic group, a combination thereof, or a bivalent group composed of a combination of an aliphatic group and/or an aromatic group with at least one of —O—, —CO—, —S—, —$SO_2$ and —$NR_9$— [$R_9$ has the same meaning as $R_7$ in general formulas (Ia), (Ib) and (Ic)]; $R_5$ represents an aliphatic group, an aromatic group or a combination thereof; $Z_1$ represents an atomic group required for forming a nitrogen-containing aromatic ring which may be fused with a benzene ring or with a heterocyclic ring; when l=1 $X^{\ominus}$ represents a counter anion or a counter anion moiety and when l=0 $Z_1$ or $R_6$ has an anion to form an inner salt; $R_6$ represents an aliphatic or aromatic group; $R_6$ group in formula (Ic) may be combined together to form a ring; $Z_1$ and $R_6$ may be substituted; $L_3$ represents —$CH_2CH_2O$— group, —$CH_2CH(CH_3)O$— group or —$CH_2CH(OH)CH_2O$— group; and n is an integer of not smaller than 3.

6. The silver halide photographic material as in claim 1, wherein the heterocyclic ring in formula (II-m) to (II-o) is substituted with at least one of a nitro group, a halogen atom, a mercapto group, a cyano group, an alkyl group, an aryl group, an alkenyl group, an aralkyl group, an alkoxy group, an aryloxy group, an alkylthio group, an arylthio group, an alkyl- and aryl-sulfonyl group, a carbamoyl group, a sulfamoyl group, an alkyl- and aryl-carbonamido group, an alkyl- and aryl-sulfonamido group, an acyloxy group, an alkyl- and aryl-sulfonyloxy group, a ureido group, a thioureido group, an acyl group, a heterocyclic group, an alkyl- and aryl-oxycarbonyl group, an alkyl- and aryloxycarbonylamino group, an amino group, —COOM', —$SO_3M'$ (wherein M' represents a hydrogen atom, an alkali metal atom or $NH_4$), and a hydroxy group; said substituents may be further substituted with at least one of these substituents.

7. The silver halide photographic material as in claim 1, wherein the bivalent bonding group represented by X is —S—, —O—, —$N(R_1)$—, —C(O)O—, —OC(O)—, —$C(O)N(R_2)$—, —$N(R_3)C(O)$—, —$SO_2N(R_4)$—, —$N(R_5)SO_2$—, —$N(R_6)C(O)N(R_7)$—, —$N(R_8)C(S)N(R_9)$—, —$N(R_{10})C(O)O$—, —$SO_2$—, —C(O)—, —(O)S(O)O—, or —O(O)S(O)—, said bonding group may be bonded to Q through a straight-chain or branched alkylene group, wherein $R_1$, $R_2$, $R_3$, $R_4$, $R_5$, $R_6$, $R_7$, $R_8$, $R_9$ and $R_{10}$ each represents a hydrogen atom, a substituted or unsubstituted alkyl group, a substituted or unsubstituted aryl group, a substituted or unsubstituted alkenyl group or unsubstituted aralkyl group.

8. The silver halide photographic material as in claim 1, wherein A represents a bivalent bonding group selected from a straight-chain or branched alkylene group, a straight-chain or branched alkenylene group, a straight-chain or branched aralkylene group an arylene group, and a combination of at least one of these groups with at least one of bivalent bonding group represented by X in formula (I).

9. The silver halide photographic material as in claim 1, wherein said substituted or unsubstituted amino group represented by B is a group represented by formula (II-b):

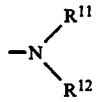

(II-b)

wherein $R^{11}$ and $R^{12}$ each represents a hydrogen atom, a substituted or unsubstituted alkyl group having 1 to 30 carbon atoms, a substituted or unsubstituted alkenyl group or a substituted or unsubstituted aralkyl group, and $R^{11}$ and $R^{12}$ may be combined together to form a saturated or unsaturated hetero ring, or may be cyclized so as to form a saturated hetero ring further having, as a member of the ring, at least one heteroatom.

10. The silver halide photographic material as in claim 9, wherein the substituent group for each of $R^{11}$ and $R^{12}$ is selected from —COOM', —$SO_3M'$ (wherein M' represents a hydrogen atom, an alkali metal atom or $NH_4$), a cyano group, a halogen atom, a hydroxyl group, an alkoxycarbonyl group, an aryloxycarbonyl group having not more than 20 carbon atoms, an alkoxy group having not more than 20 carbon atoms, a monocyclic aryloxy group having not more than 20 carbon atoms, an acyloxy group having not more than 20 carbon atoms, an acyl group having not more than 20 carbon atoms, a carbamoyl group, a sulfamoyl group, an acylamino group having not more than 20 carbon atoms, a sulfonamido group, a carbonamido group having not more than 20 carbon atoms, a ureido group having not more than 20 carbon atoms and an amino group, said substituents may be further substituted with at least one of these substituents.

11. The silver halide photographic material as in claim 1, wherein said ammonium group represented by B is a group represented by formula (II-c):

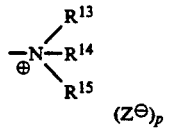

(II-c)

wherein $R^{13}$, $R^{14}$ and $R^{15}$ each represents a hydrogen atom, a substituted or unsubstituted alkyl group having 1 to 30 carbon atoms, a substituted or unsubstituted alkenyl group or a substituted or unsubstituted aralkyl group; $Z^{\ominus}$ represents an anion; and p represents 0 or 1 and when the compound forms an inner salt, p is 0 and at least one of $R^{13}$, $R^{14}$ and $R^{15}$ has an anion.

12. The silver halide photographic material as in claim 1, wherein the aliphatic group represented by $R_1$ or $R_2$ in formula (III) is an aliphatic group substituted with at least one of a substituted or unsubstituted phenyl group, an alkoxy group, an alkylthio group, a hydroxy group, —COOM', —$SO_3M'$ (wherein M' represents a hydrogen atom, an alkali metal atom or $NH_4$), an alkylamino group and an amido group.

13. The silver halide photographic material as in claim 1, wherein the bivalent aliphatic group represented by $R^3$ in formula (III) is —$R^4$— or —$R^4S$— wherein $R^4$ is a bivalent aliphatic group.

14. The silver halide photographic material as in claim 1, wherein said compound represented by formula (I) is incorporated in an amount of $1\times10^{-6}$ to $5\times10^{-2}$ mol per mol of silver halide into the emulsion layer or the adjacent hydrophilic colloid layer(s) to the emulsion layer.

15. The silver halide photographic material as in claim 1, wherein the total amount of the compounds represented by formulas (II-m) to (II-o) and (III) is $1\times10^{-3}$ to 0.5 g per $m^2$ of the photographic material.

16. A method for forming a photographic image by processing a silver halide photographic material with a developing solution having a pH of 9.6 to 11.0, said silver halide photographic material comprising a support having thereon at least one light-sensitive silver halide emulsion layer, wherein at least one of the silver halide emulsion layer and a hydrophilic colloid layer(s) adjacent thereto contains at least one hydrazine compound represented by the following general formula (I) and at least one compound selected from the group consisting of compounds represented by the following general formula (II) or (III):

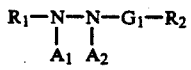

(I)

wherein $R_1$ represents an aliphatic or aromatic group which has a substituent having a moiety of —$O(CH_2CH_2O)_n$—, —O—)$CH_2CH(CH_3)O)_n$— or —O—$(CH_2CH(OH)CH_2O)_n$— (wherein n is an integer of not smaller than 3) as part of a substituent or having a moiety of a quaternary ammonium cation as part of a substituent group, $G_1$ represents a bivalent bonding group consisting of at least one of —CO—, —COCO—, —CS—, —C(=$NG_2R_2$)—, —SO—, —$SO_2$— or —P(O)($G_2R_2$)—; $G_2$ represents a single bond, —O—, —S— or —N($R_2$)—; $R_2$ represents an aliphatic group, an aromatic group or a hydrogen atom, and when there are two or more $R_2$ groups, they may be the same or different; and one of $A_1$ and $A_2$ is a hydrogen atom, and the other is a hydrogen atom, an acyl group or an alkyl- or arylsulfonyl group, when $R_1$ contains said quaternary ammonium cation, the compound further has a counter anion or has an anion group at $R_1$ to form an inner salt;

(II)

wherein Y represents a group which is adsorbed to silver halide; X represents a bivalent bonding group comprising an atom or atoms selected from hydrogen, carbon, nitrogen, oxygen and sulfur atoms; A represents a bivalent bonding group; B represents an amino group which may be substituted or unsubstituted, an ammonium group or a nitrogen-containing heterocyclic ring; m represents 1, 2 or 3; and n represents 0 or 1; and said compounds represented by formula (II) are represented by formula (II-m), (II-n), or (II-o):

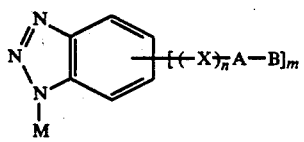

(II-m)

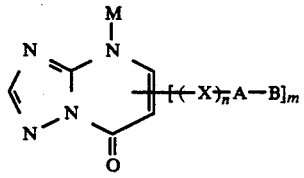

(II-n)

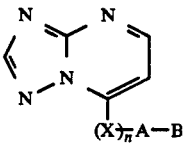

(II-o)

wherein M represents an alkali metal atom, an ammonium group or a group which is converted into H or an alkali metal atom under alkaline conditions; —$(X)_n$—A—B and m are as defined in formula (II); and wherein the heterocyclic rings in the formulas may be substituted by one or more of substituent groups;

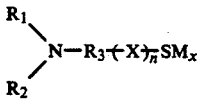

(III)

wherein $R_1$ and $R_2$ each represents a hydrogen atom or an aliphatic group, or $R_1$ and $R_2$ may be combined together to form a ring; $R_3$ represents a bivalent aliphatic group; X represents a bivalent heterocyclic ring having at least one of hetero-atom of nitrogen, oxygen and sulfur atoms; n represents 0 or 1; and M represents a hydrogen atom, an alkali metal atom, an alkaline earth metal atom, a quaternary ammonium, a quaternary phosphonium or an amidino group; x is 1 when M represents a monovalent atom or group and x is ½ when M represents a divalent atom; said compound may be in the form of an addition salt.

17. The method as claimed in claim 16, wherein the developing solution is free of an amino compound having a nucleation accelerating characteristic.

* * * * *